United States Patent [19]

Harman

[11] Patent Number: 4,803,973

[45] Date of Patent: Feb. 14, 1989

[54] GRATE FOR COAL STOVE

[75] Inventor: Dane P. Harman, Halifax, Pa.

[73] Assignee: Harman Stove and Welding, Inc., Halifax, Pa.

[21] Appl. No.: 132,809

[22] Filed: Dec. 14, 1987

[51] Int. Cl.[4] ..... F24B 13/04

[52] U.S. Cl. ..... 126/73; 126/61; 126/77; 126/163 R; 110/109

[58] Field of Search ..... 126/163 R, 152 R, 174 R, 126/155, 169, 73, 77, 60, 61, 58; 110/109, 113, 278, 282, 328, 281, 293

[56] References Cited

U.S. PATENT DOCUMENTS

| | | | |
|---|---|---|---|
| 910,305 | 1/1909 | Nisbet . | |
| 1,110,642 | 9/1914 | Nisbet . | |
| 1,406,883 | 2/1922 | Miller . | |
| 1,522,918 | 1/1925 | Skelly | 110/283 |
| 1,557,091 | 10/1925 | Riley . | |
| 1,688,608 | 10/1928 | Beers . | |
| 1,755,146 | 4/1930 | Beers . | |
| 1,757,878 | 5/1930 | Root . | |
| 1,953,335 | 4/1934 | Burton et al. | 110/48 |
| 2,035,128 | 3/1936 | Hitchcock | 110/45 |
| 2,062,481 | 12/1936 | Stone | 126/163 |
| 2,195,278 | 3/1940 | Leas | 198/226 |
| 2,471,797 | 5/1949 | Thomas | 110/44 |
| 2,932,264 | 4/1960 | Hurst | 110/38 |
| 4,328,786 | 5/1982 | Owen | 126/174 |
| 4,537,140 | 8/1985 | Baker | 110/281 |
| 4,662,290 | 5/1987 | Potts | 110/109 |
| 4,665,840 | 5/1987 | Yarnell | 110/113 |

FOREIGN PATENT DOCUMENTS

| | | | |
|---|---|---|---|
| 52033 | 2/1942 | Netherlands | 110/109 |
| 514559 | 11/1939 | United Kingdom | 110/109 |

*Primary Examiner*—James C. Yeung
*Attorney, Agent, or Firm*—Thomas Hooker

[57] ABSTRACT

An improved coal stove grate including a floor and side walls to either side of the floor. Coal is pushed along the floor, up a rise surface, past a crest at the end of the rise surface and along a fire support section to the end of the grate. Part of the coal forced up the rise surface rolls back to fill a reservoir space in the grate and fuel a fire extending the full length of the grate during heating and a stable long-burning fire during turndown of the stove.

10 Claims, 2 Drawing Sheets

GRATE FOR COAL STOVE

This invention relates to an improved grate for a coal burning stove.

The prior art includes stoves having grates with a flat floor and upstanding sidewalls in which coal is pushed from one end of the grate and along the length of the floor. Combustion air is flowed up through openings in the floor to promote burning of the coal. The burned coal ash falls off a lip at the other end of the grate. Downwardly sloping grates of this type are shown in U.S. Pat. Nos. 4,537,140 and 4,662,290.

In the present improved grate coal is pushed from a hopper on one wall of the stove into the grate and up a rise surface on the floor of the grate. The coal adjacent the floor is moved along the length of the floor and the fuel above the floor curls back to fill a reservoir space above the floor and adjacent the stove wall. The floor of the grate extends outwardly of the wall past a crest at the top of the rise surface to a discharge lip. Combustion air is blown up through openings in the floor extending from shortly before the crest to the lip. This air supports a fire along the entire top surface of the coal from the wall of the stove to the lip thereby providing a high efficiency fire.

A coal feeder pushes coal from a hopper outside of the stove through a throat and into the grate. The coal and in the throat is compacted sufficiently by the pusher to restrict air from being drawn from the hopper through the throat and into the grate when the stove is turned down, the feeder is deactivated and the combustion air blower is turned off. The absence of air flowing through the reservoir coal prevents burn back into the hopper.

During turn down the fire in the grate burns back into the reservoir coal very slowly thereby enabling a fire to be maintained for many hours. When it is desired to turn up the stove all that is required is to reactivate the combustion air blower and restart the feeder to resupply combustion air and coal to the grate. A high energy fire is quickly regenerated throughout the length of the grate.

The floor of the grate from the crest at the end of the rise surface to the lip slopes downwardly at a shallow angle to facilitate moving the burning coal fire along the grate with minimum effort without breaking up the fire.

Other objects and features of the invention will become apparent as the description proceeds, especially when taken in conjunction with the accompanying drawings illustrating the invention, of which there are two sheets and one embodiment.

IN THE DRAWINGS

Figure 3:
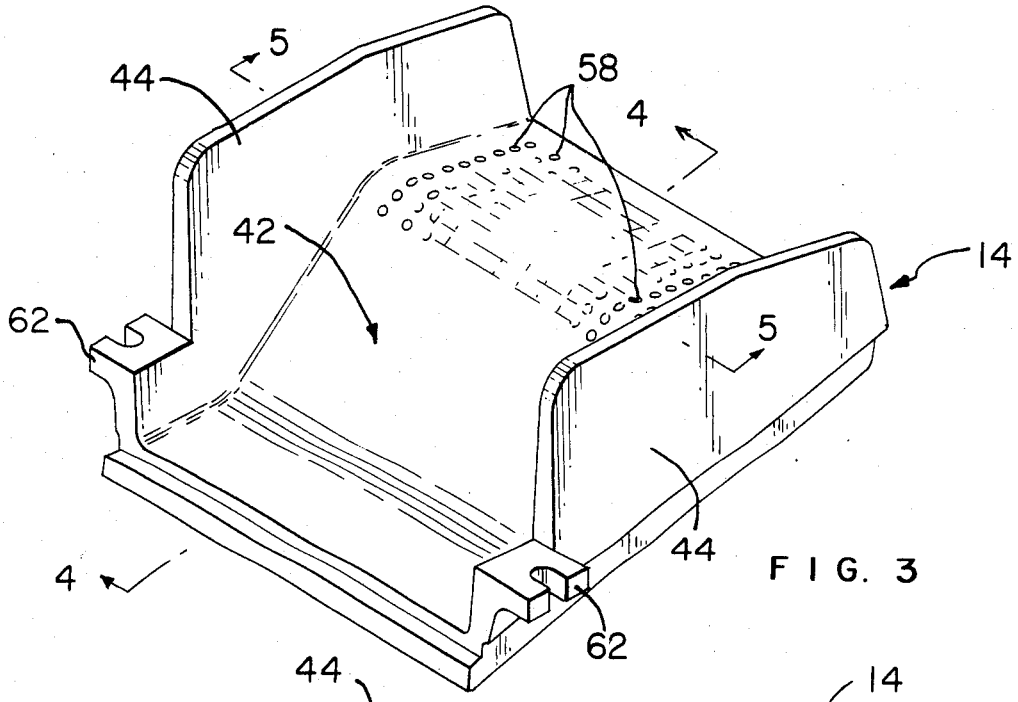
FIG. 3 is a perspective view of the grate.
Figure 4:
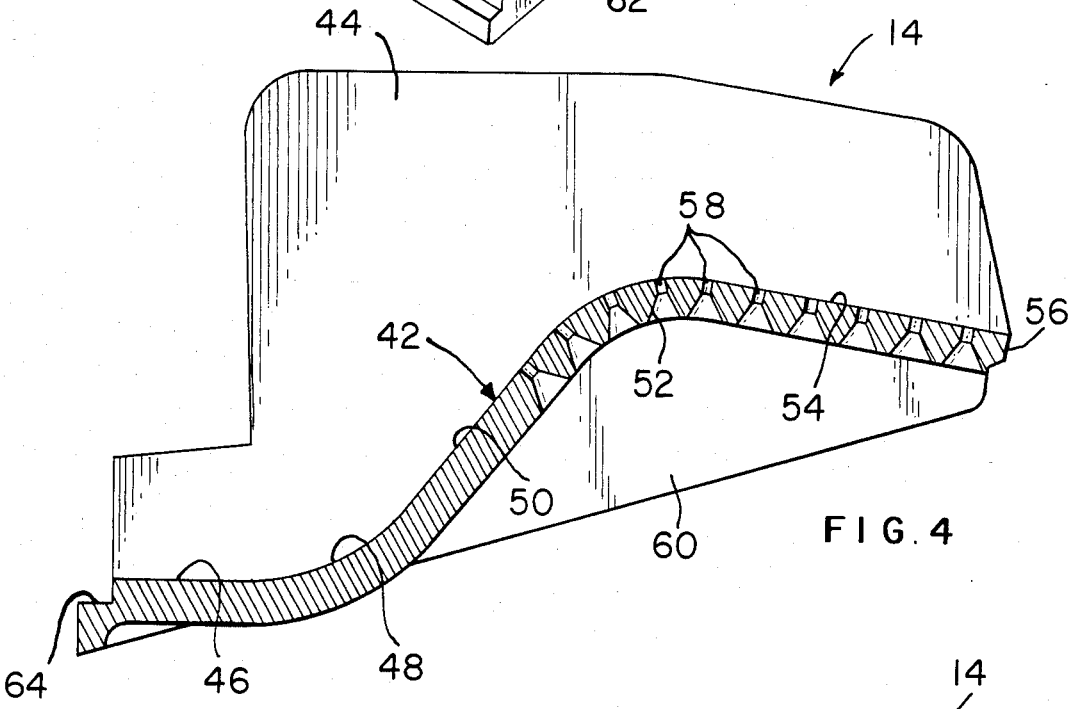
Figure 5:
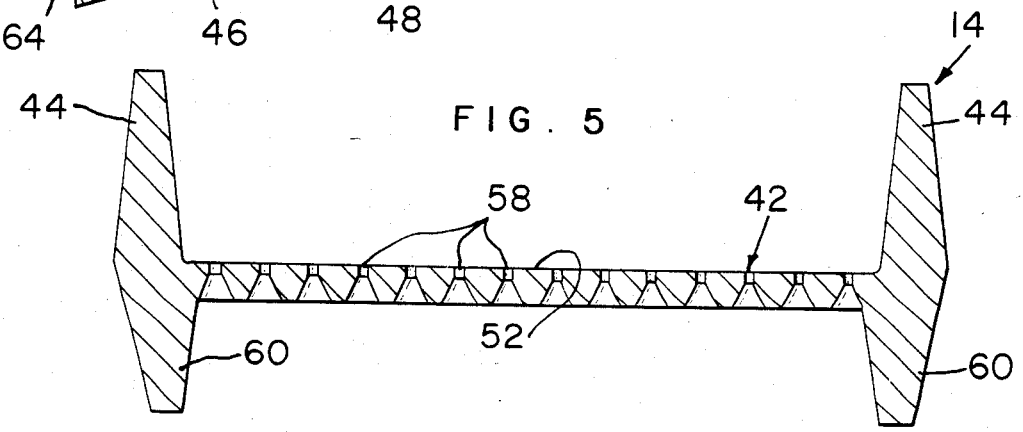

FIGS. 4 and 5 are sectional views taken along lines 4—4 and 5—5 of FIG. 3 respectively.

Heating stove 10 includes a body 12 with grate 14 supported on backwall 15 and extending into firebox 16. Feeder 18 pushes crushed coal from hopper 20 into grate 14 to maintain a fire in the stove as will be described. Ash falls off the free end of the grate 14 and is deflected by guide plate 22 into ash receptacle 24 at the bottom of the firebox 16. Inspection and clean-out doors 26 are provided on the front wall of the body.

Combustion air blower 2 blows air through passage 30 and up through openings in the floor of the grate to facilitate controlled burning of the coal moved into the grate by feeder 18. Combustion gases flow upwardly from the grate and out of box 16 through a pair of exhaust passages 32 located on either side of the firebox (only one of which is illustrated). These passages are connected to an exhaust flue 34 extending upwardly from the top of the stove. Blower 36 flows air through internal passages 38 adjacent the firebox so that the air is heated and then flows outwardly out the stove through an outlet opening 40 for improved heating.

Grate 14 as illustrated in FIGS. 3 through 5 is preferably formed from a cast iron body as illustrated, although a welded grate may be used in some situations. The grate includes a floor 42 which extends the length of the grate between two vertical and parallel side walls 44. The floor includes a flat entrance section 46 adjacent the coal feeder 18, a smooth upwardly curved transition or bend portion 48, a 50 degree rise surface 50, smoothly curved crest 52 at the top of the rise surface and a flat fire support section 54 sloping downwardly at a shallow angle of about 10 degrees from the crest 52 to ash discharge lip 56. Rows of closely spaced air holes 58 extend through floor 42 from the upper part of the rise surface 50, around crest 52 and along the flat section 54 to lip 56. As shown in FIGS. 4 and 5, strengthening webs 60 extend from lower continuations of sidewalls 44 below the floor. Slotted mounting flanges 62 extend laterally of the ends of the side walls 44 above the flat entrance section 46 to facilitate mounting the grate on the backwall 15 of stove body 12 so that the grate extends into the firebox as illustrated. A step 64 extends along the outer edge of the flat entrance section 46.

Figure 1:
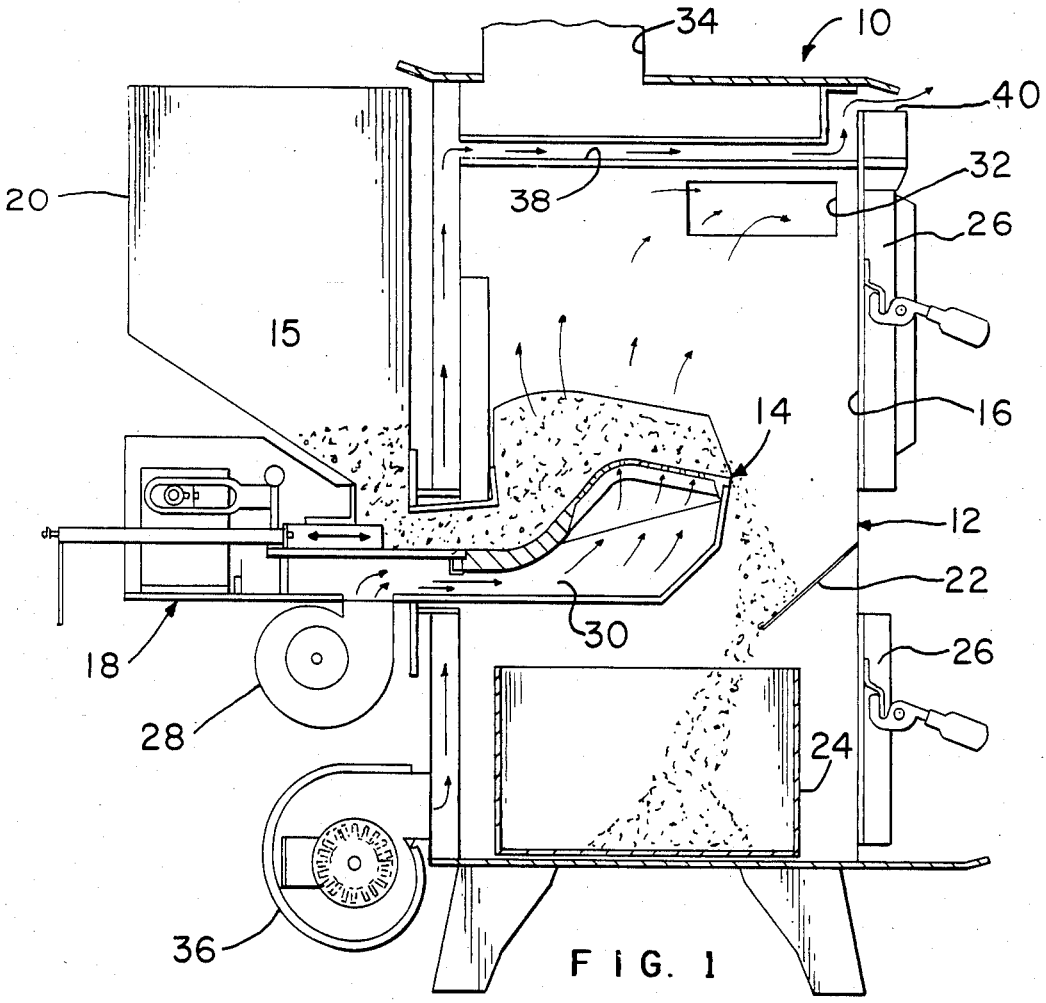
FIG. 1 is a generalized sectional view of a stove using a grate according to the invention.
Figure 2:
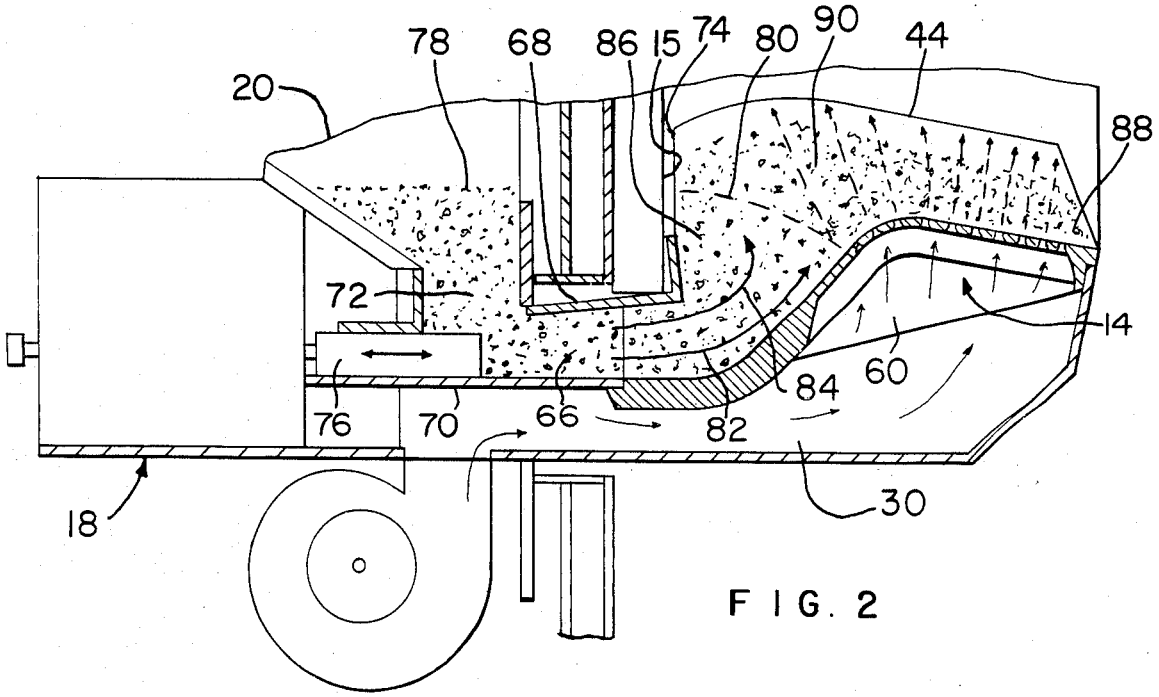
FIG. 2 is an enlarged view of a part of FIG. 1.

The grate 14 is mounted on the backwall 15 of body 12 and communicates with the bottom of hopper 20 through throat 66 defined by a plate 68 at the top of the throat extending across the thickness of the backwall and a lower horizontal plate 70 fitted in step 64 and extending from the step to feeder 18. The bottom of hopper 20 opens into a discharge passage 72 communicating with throat 66. As shown in FIGS. 1 and 2, the plate 68 is sloped upwardly from passage 72 through the throat to the grate 14 at an angle of 5 degrees so that the throat increases in cross sectional area in the direction of movement of the coal from the hopper to the grate. The throat extends the full width of floor 42. Sidewalls 44 extend upwardly along the backwall 15 with vertical edges 74 closely spaced from the wall to confine coal in the grate.

Feeder 18 includes a reciprocal pusher 76 which is moved back and forth along plate 70 to force crushed coal 78 falling down from hopper 20 and into the discharge passage 72 through throat 66 and into the grate. The feeder includes a suitable drive for moving the pusher 76 back and forth through a stroke sufficient to feed coal to the grate as required. The stroke of the pusher may be adjusted to vary the rate at which coal is delivered to the grate.

The increasing cross sectional area of the throat in the direction of feed towards the grate assures that the pusher compacts and moves the coal through the throat without jams. Coal pushed through throat 66 is packed sufficiently to prevent the air from flowing from the hopper through the throat and into the grate during turn down of the stove. The feature prevents burnback of coal through the throat and into the hopper. When the stove is turned down the pusher 18 and blower 28 are deactivated.

During high output burning of stove 10, blower 28 flows combustion air through passage 30 and out the airholes 58 formed in the grate floor from slightly before the crest to the discharge lip to facilitate burning of coal in the grate above these portions of the floor. The combustion air flowing through openings 58 also supports burning of the upper layer of coal in the grate extending back to side wall edges 74 above dotted line 80 shown in FIG. 2. The coal in the grate below line 80 does not receive high output air blown through openings 58 and does not burn until it is moved past the line.

During feeding of coal into the grate through throat 66 the coal is pushed along plate 70 and the flat entrance section of 46 of floor 42, around the upward bend section 48 and then up the rise surface 50. The coal pushed into the grate through bottom of throat 66 adjacent plate 70 moves along the grate floor in the direction of arrow 82 along section 46 and up surface 50. The coal pushed into the grate through the top of the throat 66 adjacent plate 68 moves upwardly into the interior of the grate as indicated by arrow 84 and curls back toward adjacent wall 15 to fill the interior reservoir space 86 in the grate as shown and maintain a supply of coal in the reservoir above surface 50 without forcing coal up over the sidewalls 44. The flows of coal into the grate push coal across the line 80 for combustion and ultimately advance the burning coal from line 80 along the floor and past the discharge lip 56. The feeder 18 and blower 28 are preferably adjusted so that the coal is fully burned just back of the lip 56 and there is a small ash tip 88 at the lip. During burning the sidewalls confine the coal on the floor of the grate to maintain the fire without splitting and assure discharge of ash into receptacle 24. Some fly ash falls down through openings 58 and into the receptacle 24.

The slope of the rise portion 50 is critical to achieving the desired feed of coal into and along the grate. For instance, in a grate similar to grate of 14 but with a rise surface extending at an angle of 55 or 60 degrees to the horizontal coal fed through the throat and into the grate is moved upwardly and overflows the sidewalls without sufficient movement along the floor. In a grate like grate 14 but with a rise surface extending at 40 degrees to the horizontal the coal is fed along the floor and does not fill the reservoir above the rise surface 50 and adjacent the sidewall edges 74. In the grate with a 40 degree rise surface there is an increased possibility of burnback into hopper 20 during turndown of the stove.

The flat fire support section 54 of the grate floor slopes downwardly at a ten degree angle to facilitate pushing of the burning coal along the floor toward the discharge lip 56. This section may be flat or slightly downwardly angled as shown, provided the downward angle is not sufficient to allow the coal to slide off the floor more rapidly than in response to feeding. For instance, a grate with a 20 degree downward slope at section 54 would slide the burning coal off the grate more rapidly than the coal is fed along the grate and would prematurely discharge burning coal and undesirably open the fire. The smooth curves at floor bend 46 and crest 52 facilitate feeding of the coal through the grate as described.

The height of the sidewalls 44 varies along the length of the grate and is higher than the height of the coal in the grate as shown in FIGS. 1 and 2. During burning and feeding, coal is confined in the grate for efficient combustion.

During high BTU output the blower 28 supplies combustion air to the burning coal through the forward part of floor 42. When blower 12 and feeder 18 are deactivated combustion is maintained by limited air drawn through blower 28, passage 30 holes 58 coal by flue draft. Draft air maintains a fire for a long time but does not support burn back of the coal in the grate through the throat, thereby assuring that there is no burnback into the hopper 20. A fire may be maintained in the stove 10 for a long time without risk of burnback. The fire is easily restored to high BTU output by actuating the feeder 18 and reactivating blower 28.

Grate 14 is relatively small and provides a high heat output for its size. In part, this advantage results from the fact that coal is fed up into the grate and is heated prior to movement across the line 80 and into the combustion zone 90. This type of feed effectively increases the length of the combustion zone from the sidewall edges 74 to the lip 56 without substantially increasing the length of grate. As a result, stove 10 is smaller than comparable stoves with an equivalent BTU output.

While grate 14 is primarily intended for burning rice size crushed coal having a maximum dimension of from $\frac{1}{4}$ inch to $\frac{3}{4}$ inch, the grate may also burn different size coal including buckwheat coal ($\frac{1}{2}$ to $\frac{3}{4}$ inch) and may be used to burn fuels other than coal. For instance wood pellets or chips may be burned as desired.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A stove grate for guiding fuel in two flows, the grate including a stationary floor extending between opposed ends of the grate; spaced sidewalls extending along the sides of the floor between the ends of the grate; the floor including an entrance section at one end of the gate, a fire support section at the other end of the grate above the entrance section and rise section means extending upwardly between the entrance section and the fire support section for guiding a lower fuel flow upwardly along the floor to the fire support section and for guiding an upper fuel flow located above the first flow up to fill a fuel reservoir located above the floor at the entrance section and at the lower part of the rise section means without overflowing the sidewalls; and a plurality of combustion air openings in the floor of the grate extending along the upper part of the rise section means and along the fire support section, the entrance section and the lower part of the rise section means being free of combustion air openings.

2. A stove grate as in claim 1 wherein the floor includes a smoothly rounded upward bend section between the entrance section and the rise surface and a smooth crest between the rise surface and the fire support section, and combustion air openings extend through the crest.

3. A stove grate as in claim 2 wherein the fire support section is flat.

4. A stove grate as in claim 3 wherein the fire support section slopes downwardly from the crest at a shallow angle.

5. A stove grate as in claim 3 including a mounting means on each sidewall adjacent the entrance section of the floor.

6. A stove grate as in claim 3 wherein the width of the floor is uniform along the length of the grate, said sidewalls parallel each other and including webs extending below the sidewalls at the rise surface, crest and fire support section.

7. A stove grate as in claim 1 wherein said rise section means comprises a rise surface sloping upwardly from the entrance section to the fire support section at an angle of about 50 degrees to the horizontal.

8. The method of feeding particulate fuel along a grate extending from a fire box wall, the grate having a floor and upstanding sidewalls including the steps of:

(a) Pushing fuel through the wall and into the grate floor between the sidewalls;

(b) Moving a first flow of fuel along the grate floor and up a rise surface;

(c) Moving a second flow of fuel into the grate above and with the first flow of fuel and then vertically and back toward the firebox wall to fill a fuel reservoir in the grate above the floor;

(d) Moving both flows of fuel into and along a combustion zone extending from the firebox wall to the free end of the grate; and (e) Flowing combustion air through the floor of the grate and through the combustion zone to burn the fuel in the combustion zone without burning the fuel in the reservoir.

9. The method of claim 8 including the step of moving the first fuel flow up a rise surface extending upwardly at a approximately 50 degrees.

10. The method of claim 9 including the step of flowing combustion air up through openings formed through the grate floor from the top of the rise surface to the free end of the grate.

* * * * *